US007891648B2

(12) United States Patent
Abegglen

(10) Patent No.: US 7,891,648 B2
(45) Date of Patent: Feb. 22, 2011

(54) APPARATUS FOR GATHERING AND/OR ASSEMBLING PRINT PRODUCTS

(75) Inventor: Christian Abegglen, Frauenfeld (CH)

(73) Assignee: Mueller Martini Holding AG, Hergiswil (CH)

( * ) Notice: Subject to any disclaimer, the term of this patent is extended or adjusted under 35 U.S.C. 154(b) by 693 days.

(21) Appl. No.: 11/519,218

(22) Filed: Sep. 12, 2006

(65) Prior Publication Data

US 2007/0069442 A1 Mar. 29, 2007

(30) Foreign Application Priority Data

Sep. 12, 2005 (EP) ..... 05405536

(51) Int. Cl.
*B65H 39/00* (2006.01)
*B65H 37/04* (2006.01)

(52) U.S. Cl. ..... 270/52.16; 270/52.14; 271/10.03

(58) Field of Classification Search ..... 270/52.14, 270/52.16, 52.26, 52.29; 271/9.01, 9.02, 271/9.05, 10.02, 10.03
See application file for complete search history.

(56) References Cited

U.S. PATENT DOCUMENTS

| | | | | |
|---|---|---|---|---|
| 3,175,821 | A * | 3/1965 | Gibson | 270/58.29 |
| 5,031,891 | A | 7/1991 | Kobler et al. | |
| 5,326,087 | A * | 7/1994 | Colson et al. | 270/58.02 |
| 5,421,699 | A | 6/1995 | Guiles et al. | |
| 5,499,803 | A * | 3/1996 | Farr | 270/52.14 |
| 5,595,379 | A * | 1/1997 | Hoang | 270/52.06 |
| 5,685,531 | A | 11/1997 | Auerbach et al. | |
| 5,876,029 | A | 3/1999 | Wright et al. | |
| 5,924,686 | A * | 7/1999 | Jacobson et al. | 271/3.17 |
| 6,082,724 | A * | 7/2000 | Kahlig et al. | 270/52.14 |
| 6,776,412 | B2 * | 8/2004 | DaCunha et al. | 271/274 |

FOREIGN PATENT DOCUMENTS

| | | |
|---|---|---|
| CH | 446 269 | 3/1968 |
| EP | 1 065 074 A2 | 1/2001 |
| EP | 1 357 069 A | 11/2003 |

OTHER PUBLICATIONS

European Search Report dated Nov. 23, 2005.

* cited by examiner

*Primary Examiner*—Leslie A Nicholson, III
(74) *Attorney, Agent, or Firm*—Venable LLP; Robert Kinberg; Leigh D. Thelen

(57) ABSTRACT

An apparatus for gathering and/or assembling print products or supplements comprises a conveying section on a conveyor, along which feeding devices for supplying different types of print products are arranged. The feeding devices are driven with synchronous timing and are connected by respectively one drive to the conveyor. The conveyor and at least one feeding device are driven separately. A first measuring device is detects the position of a print product conveyed on a conveying section of the conveying track. A second measuring device is detects the position of a different print product located on a feed conveyor of one of the feeding devices. The measuring devices are connected to a control unit with computing capacity that is arranged to control the drives of the feeding devices.

20 Claims, 4 Drawing Sheets

APPARATUS FOR GATHERING AND/OR ASSEMBLING PRINT PRODUCTS

CROSS-REFERENCE TO RELATED APPLICATION

This application claims the priority of European Patent Application No. 05405536.3, filed on Sep. 12, 2005, the disclosure of which is incorporated herein by reference.

BACKGROUND OF THE INVENTION

The invention relates to an apparatus for gathering and/or assembling print products or supplements, such an apparatus comprising a working belt section, forming a conveying track on a circulating conveyor traction means, which is provided with uniformly spaced-apart pushers, as well as synchronously driven feeding devices arranged along the conveying track, which differ at least in that they supply different types of print products and are connected to the conveyor by respectively one drive unit.

Machines of the aforementioned type are used in the print processing industry for gathering and assembling print products, such as printed sheets, cards, CD/DVD-ROM, or other flat objects into loose material stacks. Such machines are understood to include assemblers as well as gathering and wire-stitching machines and inserting machines. Feeding devices provided with respectively one type of print product to be assembled are arranged along a horizontal conveying track. The assembled materials are transported and moved along the conveying track by pushers attached to a circulating traction means. Depending on the design, the conveying direction for the such machines can be in a longitudinal direction of the back or transverse thereto. The design for a support mechanism positioned along the conveying track depends on the respective use.

A gathering and assembling apparatus of this type comprises an L-shaped support mechanism, consisting of an approximately perpendicular guide wall against which the print products rest with their back region and a bottom section that is slanted relative to the guide wall. Pushers or ends stops are provided against which the print products are aligned in longitudinal back direction. As a result, the gathered and assembled sheets or signatures are aligned in a longitudinal direction along the back.

A known apparatus is disclosed, for example, in Swiss reference CH 446 269 for which evenly spaced-apart pushers that are mounted on a circulating, driven traction means jointly form a conveying apparatus that pushes the assembled material stacks through a conveying channel. The compiled materials are aligned precisely with the pusher that pushes them in the conveying direction. On the path through the conveying channel, respectively one print product is deposited by each feeding device in front of a pusher, so that a completely assembled loose book block is positioned before each pusher at the end of the assembling section. Further known is a conveying apparatus where the print products are gathered and/or conveyed with the back of the print product positioned transverse to the conveying direction.

Print products for a gathering and wire-stitching operation are gathered while positioned straddling on a roof-shaped support and must be opened up individually in dead center before they are deposited on the conveyor. Their position in a transverse direction on the conveying apparatus is defined by the ridge of the roof-shaped support and an end stop or pusher in the longitudinal direction of the back.

With gathering and assembling machines used for inserting supplements, the print product feeding devices are arranged along a conveying track, wherein the so-called main signature is supplied first and is opened dead center to create a type of pocket into which the print products to be inserted can be placed by the following feeding devices.

The timing of the conveyor drive is synchronized with a following processing machine in the conveying direction, for example a perfect binder or a gathering and wire-stitching machine, by using an electric motor, for which the timing is synchronized with the following processing machine, or by a mechanical connection to the central drive of the following processing machine. The feeding devices are driven individually, in groups, or centrally. The drives for the feeding devices and the conveyor drive are synchronized so that the supplied print products are deposited at the correct location on the material stacks. Depending on the type of drive used for the feeding devices, this can be achieved with the aid of a mechanical connection or a drive control if a motor is used.

The known apparatuses have the disadvantage that the drives for the feeding devices and the conveyor drive are rigidly connected. As a result, the accumulated error of a pusher relative to the sheet feeder increases with increasing distance to the conveyor drive, owing to dividing errors on the conveyor. Since the traction means for the conveyor is generally embodied as a chain, the tolerances continuously increase due to chain wear. Also not taken into consideration are deformations in the drive elements caused by the torque and the forces to be transferred, which additionally contribute to worsening the synchronizing accuracy. The operational safety consequently can be reduced when processing standard-size print products of the same format on longer gathering apparatuses. For example, a precise feeding of supplements to be glued onto the top sheet of a material stack, such as cards, CD/DVD-ROM, or other flat products, is not possible in this way because the relative inaccuracies between conveyor and drive are too pronounced.

SUMMARY OF THE INVENTION

It is therefore an object of the present invention to convey the last supplied print product in the conveying direction so that it is precisely aligned with the top print product on the material stack.

The above and other objects are accomplished according to the invention wherein there is provided in one exemplary embodiment an apparatus for gathering and/or assembling print products or supplements, comprising: a conveyor comprising a circulating traction mechanism, a conveying track on the traction mechanism, and uniformly spaced-apart pushers attached to the conveying track and defining respective conveying sections along the conveying track; feeding devices, each including a feed conveyor, arranged along the conveying track for supplying different print products to respective conveying sections of the conveying track; a plurality of feeding device drives each arranged to drive a respective one of the feeding devices with synchronized timing; a conveyor drive which is separate from at least one of the feeding device drives to drive the conveyor; a first measuring device arranged to detect a position of a print product conveyed on one of the conveying sections of the conveying track; a second measuring device arranged to detect a position of a different print product on one of the feed conveyors; and a control unit having computing capacity and being coupled to the first and second measuring devices to control the feeding device drives in response to outputs from the first and second measuring devices.

That is, according to an exemplary embodiment of the invention, there is provided a separate drive for the conveyor and at least one feeding device. Further, there is additionally provided a first measuring device or sensor for detecting the position of a print product transported on a conveying section of the conveying track, and a second measuring device or sensor for detecting an additional print product located on the feed conveyor. These measuring devices are connected to a control unit with computing capacity.

BRIEF DESCRIPTION OF THE DRAWINGS

These and other features and advantages of the invention will be further understood from the following detailed description of the exemplary embodiments, with reference to the accompanying drawings, wherein.

DETAILED DESCRIPTION OF EXEMPLARY EMBODIMENTS

Figure 1:
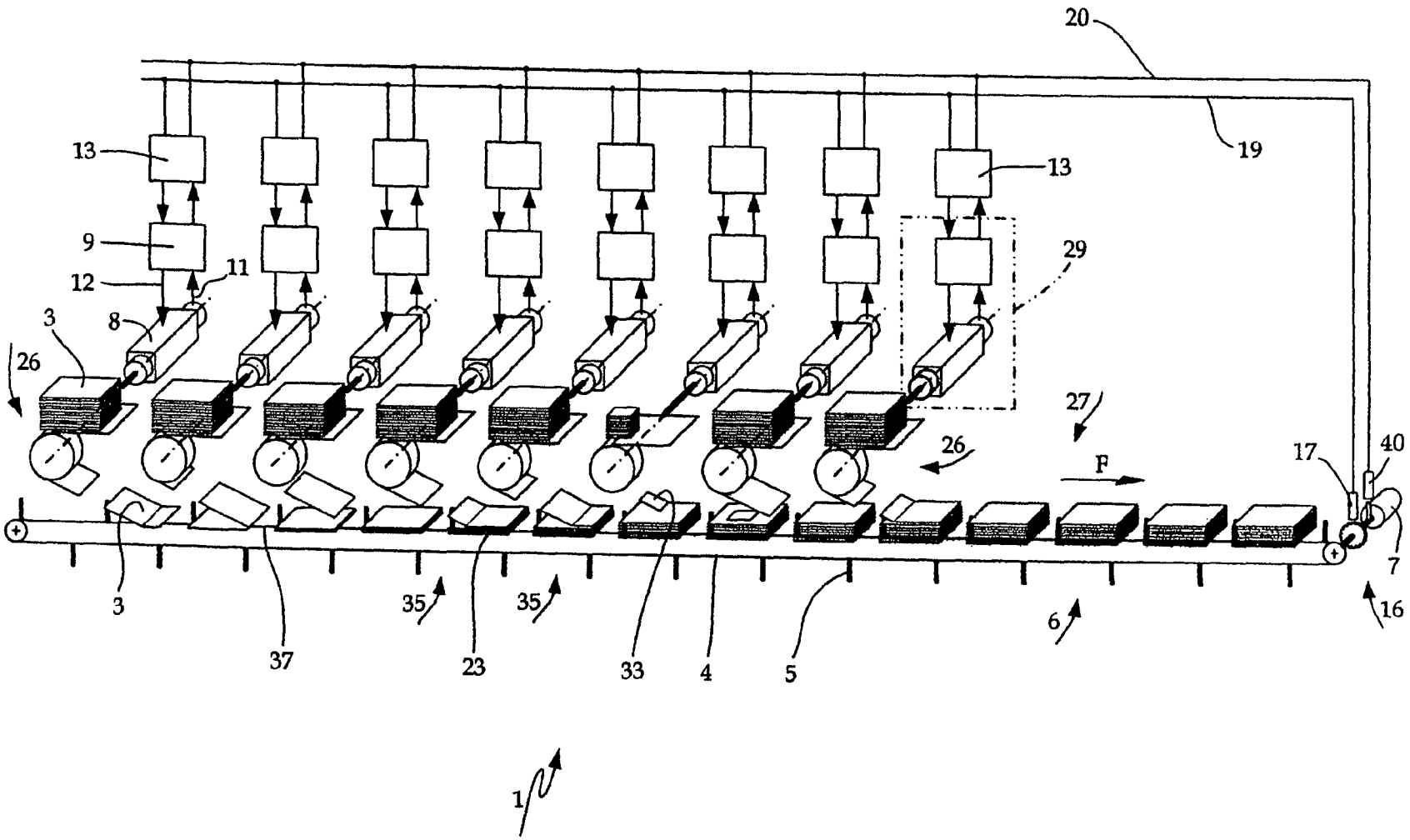
FIG. 1 illustrates a simplified, three-dimensional representation of a gathering and assembling apparatus according to the invention.
Figure 3:
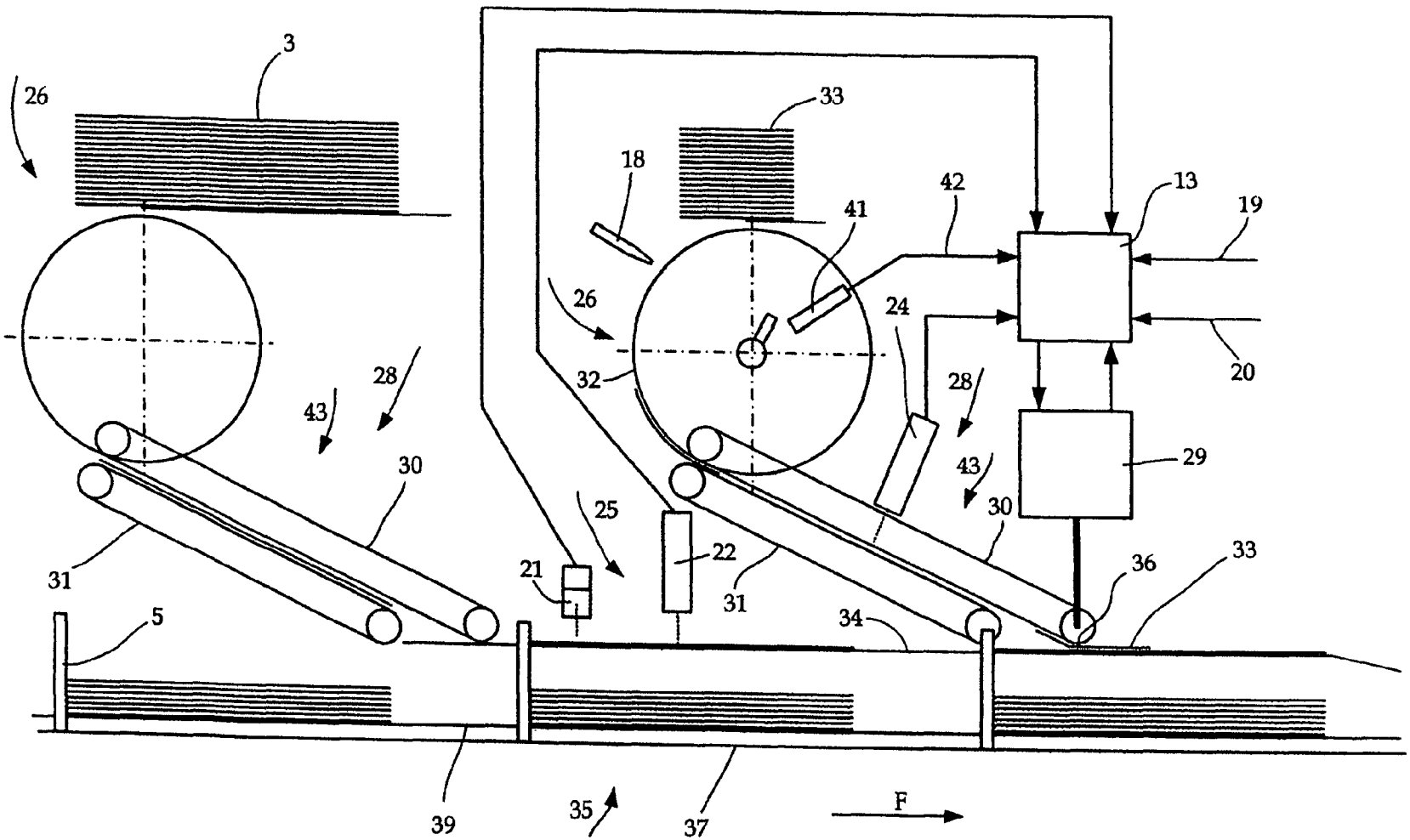
FIG. 3 is a simplified representation of a device for feeding supplements.
Figure 4:
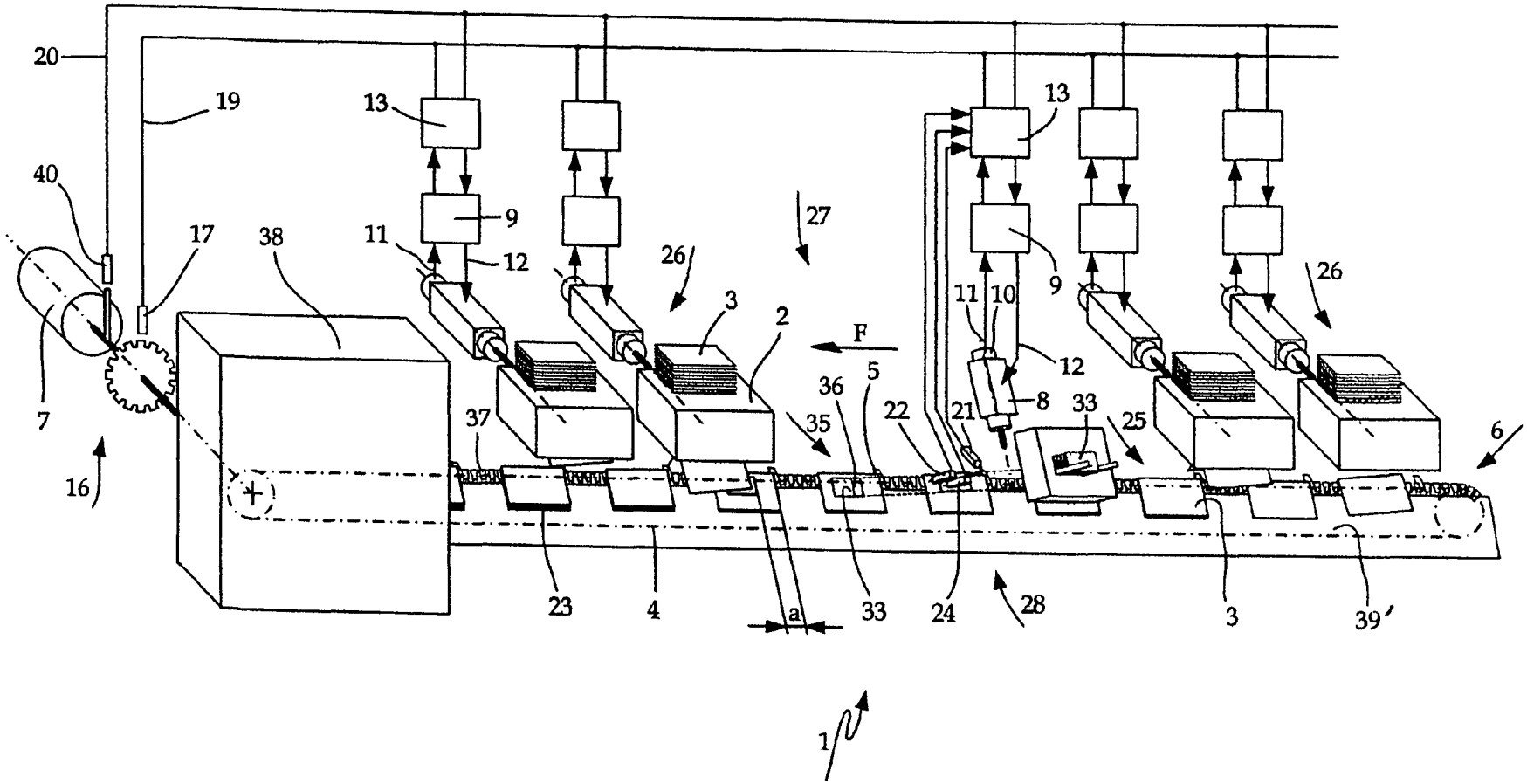
FIG. 4 is a simplified, three-dimensional view of an alternative gathering and assembling apparatus according to the invention.

The gathering and assembling apparatuses 1 shown in FIGS. 1 and 4 primarily comprise a conveying track 27 and feeding devices 26 arranged along the conveying track 27. The conveying track 27 comprises a working belt section 37 of a conveyor 6 of a circulating traction mechanism 4, with thereon arranged uniformly spaced-apart pushers 5 that define receiving locations 25 for material stacks 23. Material stacks 23, consisting of print products 3 and supplements 33, are compiled on a support 39 (see FIG. 3) and are displaced in a conveying direction F. Print products 3 or supplements 33 are supplied by feeding devices 26 to conveying sections 35 along the conveying track 27, wherein at least one feeding device 26 is assigned to each conveying section 35. The gathering and assembling apparatus 1 shown in FIG. 1 could be used, for example, for assembling material stacks 23 for a perfect binder while the gathering and assembling apparatus 1 shown in FIG. 4 could be used for supplying material stacks 23 to a gathering and wire-stitching machine. When gathering and assembling material for a perfect binding operation, the various print products 3 are compiled one on top of the other inside a channel by feeding devices 26, arranged along the conveying track 27, so that complete material stacks 23 are available at the end of the conveying track 27. When assembling material for the gathering and wire-stitching process according to FIG. 4, the print products 3 are gathered while opened up and positioned straddling on a roof-shaped support 39', composed of support elements, wherein the traction mechanism 4 is operated by a drive 7, such as a motor.

Figure 2:
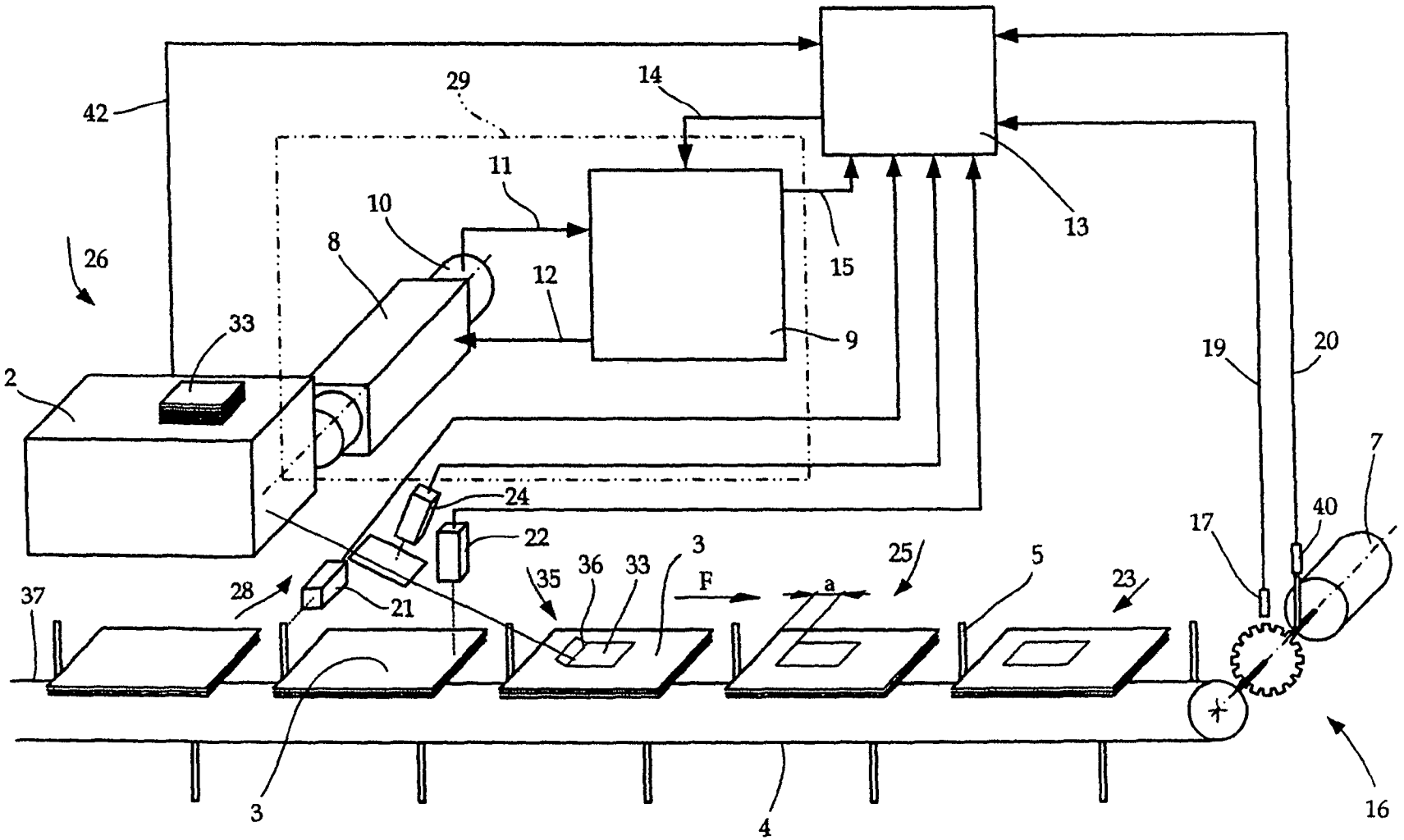
FIG. 2 shows a detail from FIG. 1.

The feeding devices 26 comprise feeding elements 2, which remove the print products 3 individually from existing stacks and supply these to feed conveyors 28, by which the print products 3 are deposited in a precise position on the material stacks 23 that are so formed. A person skilled in the art is familiar with the different designs for the feeders 2. The feeders 2 shown in the Figures are drum feeders, although other types of feeders may be used. The lowest print product 3 and/or the lowest supplement 33 of a stack is partially separated from the stack by suction means and is subsequently gripped by grippers arranged on the drums 32, is then conveyed away from the stack and is deposited on a feeding section 43 that is embodied as a feed conveyor 28. As shown in FIG. 3, a circulating upper belt section 30 with cooperating lower belt section 31, for example, can function as the feed conveyor 28 between which the print products 3 are conveyed while frictionally clamped in. It is also conceivable to use a circulating chain with a plurality of grippers attached thereto, to convey the print products 3 from the feeder 2 to the combining location 36 and there deposit it on the top print product 3 of the material stack 23. The print products 3 normally are fitted against the pushers 5, which push the material stack 23 along, and are thus precisely aligned and referenced on that side. However, smaller format print products 3, for example smaller format supplements 33, in most cases must be supplied with a desired position value "a," equal to or larger than 0, relative to the top of print product 3 of a material stack 23 on the conveying track (see FIGS. 2 and 4). Following the assembly, these supplements 33 or print products 3 are furthermore glued to the print product 3 positioned underneath to retain their position relative thereto. A glue applicator head 18 is provided for this purpose, which applies glue to each supplement 33 to be glued on. Alternatively, the glue could also be applied to the top print product 3 on the material stack 23 prior to combining it with the supplement 33. In place of a glue application, the supplements 33 and the print products 3, which must be combined, could also be provided with an electrostatic charge that causes at least a temporary connection between them. Each feeding device 26 comprises a separate variable speed drive 29 for driving at least the feed conveyor 28 and, according to one preferred embodiment, also the feeder 2. The variable speed drive 29 comprises a motor 8 with a position sensor 10 and a servo control 9, which are connected to each other by a feedback line 11 and an energy supply line 12. Alternatively, the variable speed drive 29 could also be embodied as a stepping motor with an associated stepping motor control, wherein the position sensor 10 and the feedback line 11 could then be omitted. Also known are drive systems where the rotor position can be detected directly by the servo control 9, thereby making it possible to also omit the position sensor 10. According to a further exemplary embodiment, a linear motor could be used in place of the motor 8. The servo control 9 may be connected to a control unit 13, which continuously supplies at least the desired values 14 for the position of the drive. The servo control then feeds the actual values 15 back to the control unit 13. To determine the position of the drive 7 for the pushers 5, the control unit 13 is connected via the signal line 19 for precise timing to at least one precise timing sensor 17 of a distance measuring system 16. As is known, the functions of the control unit 13 and the servo control 9 can be combined and supplied by a single unit. However, this does not change the previously described sequences and functions.

Position sensors 22 for measuring the position of at least the top print product 3 on a material stack 23 and position sensors 24 for measuring the position of the print product 3 or the supplement 33 to be supplied are provided upstream of the location 36 for combining a print product 3 or a supplement 33 with the print product 3 positioned underneath. Based on the two measuring values supplied by the sensors 22, 24, the control unit 13 then computes the expected position (actual position value "a") of print product 3 or supplement 33 to be supplied, relative to the top print product 3 of the material stack 23. As an alternative to measuring the position of the top print product 3 of a material stack 23, a position sensor 21 can be used to measure the position of the pusher 5 against which the top print product 3 of a material stack 23 rests. In this way, the variable speed drives 29 function as position-controlled slaves that are controlled by the master drive, which is the drive 7 for the conveying device 6. A system of this type is referred to as a "synchro" system. Thus, by measuring the expected effective position of a print product 3 or supplement 33 to be supplied to the top print product 3 on the material stack 23 and comparing this value to the desired position value "a," the desired value 15 of the variable speed drive 29 can be corrected accordingly. The previously determined deviation between the actual position value "a" and the desired position value "a" can also be compensated. Geometric defects on the conveyor 6 that are caused by deformations, production tolerances, and wear are thus continuously detected and compensated, so that the print products 3 and the supplements 33 to be supplied in the conveying direction F are deposited precisely aligned with the top print product 3 of a material stack 23. The position sensors 21, 22, 24 may be positioned as close as possible upstream of the combining location 36, but at least far enough away so that a new desired value can be computed by the variable speed drive 29, even for the maximum production speed.

Shutting down the machine, of necessity, also deactivates the complete control. If manual changes are then made to the machine, the control unit 13 will not be able to detect these changes. The variable speed drives 29 can thus lose their reference, which can only be restored by conveying the print products 3 and supplements 33, as well as detecting their positions with the aid of the above-described sensors and control units 13. To avoid such an occurrence, reference cycles can be generated on the feeding devices 26 and the conveyor 6, wherein the reference cycle for the conveyor 6 can be transmitted via the signal line 20 and the reference cycle for the feeding devices 26 can be transmitted via the signal line 42 to the control unit 13. The reference cycles are respectively generated once for each machine cycle by the reference cycle sensor 40 on the conveyor 6 and the reference cycle sensors 41 for the feeding devices 26. The position in time within a machine cycle is defined by mechanical adjustments, thus making it possible to approximately synchronize the operation of the variable speed drives 29 with that of the conveyor 6, without the conveying of products 3 or supplements 33. The accuracy which can be achieved with this process corresponds to that of devices according to the prior art. The position "a" can furthermore be determined with the aid of the position sensor 22 for the material stacks and the reference cycle sensor 41 for the feeding device. Even though this mode of operation does not fully reach the possible accuracy, it nevertheless considerably surpasses that which can be reached with devices according to prior art.

It is not absolutely necessary for the print product 3 or the supplement 33 to be combined with the print product 3 on top of the material stack 23. The print product 3 or supplement 33 can be moved temporarily along on a support element 34 that is arranged above the support means 39, wherein the pushers 5 can still be used for the conveying operation, as shown in FIG. 3.

It is furthermore conceivable to detect the position of a supplement 33 or a print product 3, relative to the print product 3 positioned underneath, by using an image recognition system, installed downstream of the combining location 36. With an image recognition system, it is possible to detect supplements 33 supplied in the conveying direction F and/or transverse thereto or at an angle thereto and to remove these when a permissible limit value is exceeded.

FIG. 4 shows an alternative embodiment of a gathering and assembling apparatus 1, for example one used for feeding a wire-stitching unit 38 of a gathering and wire-stitching machine, wherein the drive functions in the same way as that of a gathering and assembling machine for a perfect binder. The essential difference is that the print products 3 for the gathering and wire-stitching operation are deposited straddling, one above the other, in the opened state on a roof-shaped conveying section 27 and are assembled in this fashion.

It will be understood that the above description of the present invention is susceptible to various modifications, changes and adaptations, and the same are intended to be comprehended within the meaning and range of equivalents of the appended claims.

What is claimed is:

1. An apparatus for gathering and/or assembling print products or supplements, comprising:

a conveyor to convey first print products comprising a circulating traction mechanism, a conveying track on the traction mechanism, and uniformly spaced-apart pushers attached to the conveying track and defining respective conveying sections along the conveying track;

feeding devices, each including a feed conveyor, arranged along the conveying track for supplying second print products to assemble on the first print products at respective conveying sections of the conveying track;

a plurality of feeding device drives each arranged to drive a respective one of the feeding devices with synchronized timing;

a conveyor drive which is separate from at least one of the feeding device drives to drive the conveyor;

a first measuring device arranged to detect a position of a first print product conveyed on one of the conveying sections of the conveying track;

a second measuring device arranged to detect a position of a second print product on one of the feed conveyors; and a control unit having computing capacity and being coupled to the first and second measuring devices to synchronize a feeding device drive of one of the feeding devices with a respective conveying section to assemble the second print product in a pre-determined position on the first print product in response to position outputs from the first and second measuring devices, wherein the control unit comprises a computer adapted to compute an actual position value of the first print products on at least one of the conveying sections or an actual position value of a second print product on one of the feed conveyors as a function of the position detection of at least one of the first and second measuring devices, and for comparing the actual position value to a desired position value for the first and second print products to control the feed conveyor based on a differential value.

2. The apparatus according to claim 1, wherein the conveyor conveys the first print products in a conveying direction and the first measuring device is arranged upstream of a combining location on the conveying track, as seen in conveying direction, where the second print product is combined with the first print product.

3. The apparatus according to claim 2, wherein the feeding device drives each comprise a torque-controlled variable speed drive coupled between a respective one of the feeding devices and the control unit.

4. The apparatus according to claim 3, wherein the torque-controlled variable speed drive comprise a servo drive.

5. The apparatus according to claim 3, wherein the feed conveyor of each feeding device is connected to a respective one of the torque-controlled variable speed drives.

6. The apparatus according to claim 5, wherein the second measuring device comprises a sensor arranged in association with the feed conveyor to measure the position of the second print product.

7. The apparatus according to claim 6, wherein the sensor is connected to the control unit.

8. The apparatus according to claim 3, wherein the feed conveyor is connected via a separate variable speed drive to the control unit.

9. The apparatus according to claim 1, wherein at least one of the first and second measuring devices is directed toward the front edge or the rear edge of the first and second print product, respectively, to measure the position of the first and second print product on the conveying section or the feed conveyor, respectively.

10. A method of gathering and/or assembling print products or supplements comprising using the apparatus according to claim 1 in a gathering and assembling apparatus or as a compiler on a gathering and wire-stitching machine.

11. An apparatus for gathering and/or assembling print products or supplements, comprising:

a conveyor to convey first print products comprising a circulating traction mechanism, a conveying track on the traction mechanism, and uniformly spaced-apart pushers attached to the conveying track and defining respective conveying sections along the conveying track;

feeding devices, each including a feed conveyor, arranged along the conveying track for supplying second print products to assemble on the first print products at respective conveying sections of the conveying track;

a plurality of feeding device drives each arranged to drive a respective one of the feeding devices with synchronized timing;

a conveyor drive which is separate from at least one of the feeding device drives to drive the conveyor;

a first measuring device arranged to detect a position of a first print product conveyed on one of the conveying sections of the conveying track;

a second measuring device arranged to detect a position of a second print product on one of the feed conveyors;

a third measuring device arranged to detect a position in time of the second print product within a machine reference cycle of at least one of the feeding devices; and a control unit having computing capacity and being coupled to the first and second measuring devices to synchronize a feeding device drive of one of the feeding devices with a respective conveying section to assemble the second print product in a pre-determined position on the first print product in response to position outputs from the first and second measuring devices, wherein the control unit coupled to the first measuring device and the third measuring device determines a placement position of a leading edge of the second print product on the first print product.

12. The apparatus according to claim 11, wherein the conveyor conveys the first print products in a conveying direction and the first measuring device is arranged upstream of a combining location on the conveying track, as seen in conveying direction, where the second print product is combined with the first print product.

13. The apparatus according to claim 12, wherein the feeding device drives each comprise a torque-controlled variable speed drive coupled between a respective one of the feeding devices and the control unit.

14. The apparatus according to claim 13, wherein the torque-controlled variable speed drive comprise a servo drive.

15. The apparatus according to claim 13, wherein the feed conveyor of each feeding device is connected to a respective one of the torque-controlled variable speed drives.

16. The apparatus according to claim 15, wherein the second measuring device comprises a sensor arranged in association with the feed conveyor to measure the position of the second print product.

17. The apparatus according to claim 16, wherein the sensor is connected to the control unit.

18. The apparatus according to claim 13, wherein the feed conveyor is connected via a separate variable speed drive to the control unit.

19. The apparatus according to claim 11, wherein at least one of the first and second measuring devices is directed toward the front edge or the rear edge of the first and second print product, respectively, to measure the position of the first and second print product on the conveying section or the feed conveyor, respectively.

20. A method of gathering and/or assembling print products or supplements comprising using the apparatus according to claim 11 in a gathering and assembling apparatus or as a compiler on a gathering and wire-stitching machine.

* * * * *